US007458579B2

(12) United States Patent
Tsai et al.

(10) Patent No.: US 7,458,579 B2
(45) Date of Patent: Dec. 2, 2008

(54) SOCCER GAME TABLE

(76) Inventors: Lore Tsai, No. 22, Lane 20, Zichiang Street, Taichung (TW); Sin Lun Lee, 4, No. 13, lin Chuan Street, Kaohsiung (TW)

( * ) Notice: Subject to any disclaimer, the term of this patent is extended or adjusted under 35 U.S.C. 154(b) by 27 days.

(21) Appl. No.: 11/676,308

(22) Filed: Feb. 18, 2007

(65) Prior Publication Data

US 2008/0197564 A1 Aug. 21, 2008

(51) Int. Cl.
*A63F 7/00* (2006.01)

(52) U.S. Cl. ..... 273/108.52; 273/108.1

(58) Field of Classification Search ..... 273/273, 273/108–108.56, 119 R, 119 A, 126 A, 129 R–129 W
See application file for complete search history.

(56) References Cited

U.S. PATENT DOCUMENTS 3,741,541 A * 6/1973 Crismani ..... 273/108.52
6,561,511 B1 * 5/2003 Vaysberg et al. ..... 273/108.56
6,682,070 B1 * 1/2004 Rosenfeld et al. ..... 273/108.1
6,851,673 B2 * 2/2005 Tsai ..... 273/108.1
2001/0033053 A1 * 10/2001 Rossi et al. ..... 273/108.52
2003/0168800 A1 * 9/2003 Tsai ..... 273/108.52
2005/0001375 A1 * 1/2005 Tsai ..... 273/108.1

* cited by examiner

*Primary Examiner*—Nini Legesse
(74) *Attorney, Agent, or Firm*—Ming Chow; Sinorica, LLC

(57) ABSTRACT

A soccer game table includes a table body having two lateral sides and two end sides which define a game space. Each lateral side is formed with at least one slide slot. A predetermined number of operation bars are fitted through the slide slots of the lateral sides of the table body. The operation bars are rotatable within the slide slots and axially movable. In addition, the operation bars are movable along the slide slots. Therefore, the driving blocks mounted on the operation bars can be driven to rotate and two-dimensionally displace. Accordingly, the ball of the soccer game in the game space can be more efficiently driven.

17 Claims, 13 Drawing Sheets

SOCCER GAME TABLE

BACKGROUND OF THE INVENTION

The present invention is related to a game device, and more particularly to a soccer game table.

A conventional soccer game table has several parallel operation bars passing through two long sides of the table body. Several driving blocks are fitted on each operation bar. By means of operating the operation bars, the driving blocks can be rotated and moved so as to drive the ball on the table body and play the game.

According to the above arrangement, the operation bars of the conventional soccer game table are mounted on the table body in fixed position. The operation bars can be only rotated and axially moved. As a result, the operation bars can simply rotate and linearly move the driving blocks. It is impossible for the operation bars to drive the driving blocks to move in any other direction. Therefore, the movement of the operation bars of the conventional soccer game table is quite limited.

SUMMARY OF THE INVENTION

It is therefore a primary object of the present invention to provide a soccer game table having novel usage. The operation bars of the soccer game table can be two-dimentionally operated to move the driving blocks.

According to the above object, the soccer game table of the present invention has a table body. Each of two lateral sides of the table body is formed with slide slots. The operation bars are fitted through the slide slots and movable along the slide slots. Therefore, the operation bars can be rotated and axially moved as well as transversely displaced along the slide slots.

The present invention can be best understood through the following description and accompanying drawings wherein:

DETAILED DESCRIPTION OF THE PREFERRED EMBODIMENTS

Figure 1:
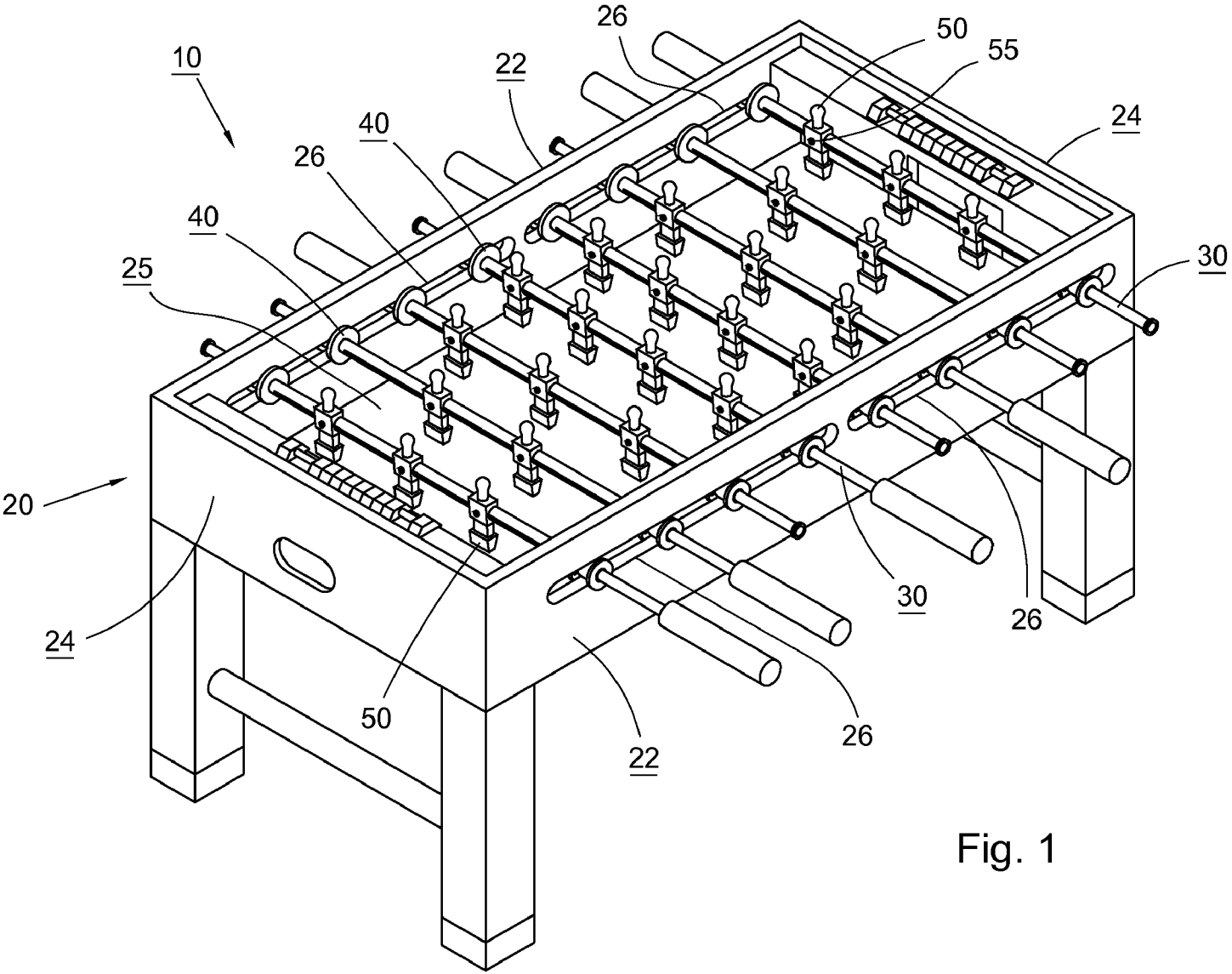
FIG. 1 is a perspective view of a first embodiment of the present invention.
Figure 2:
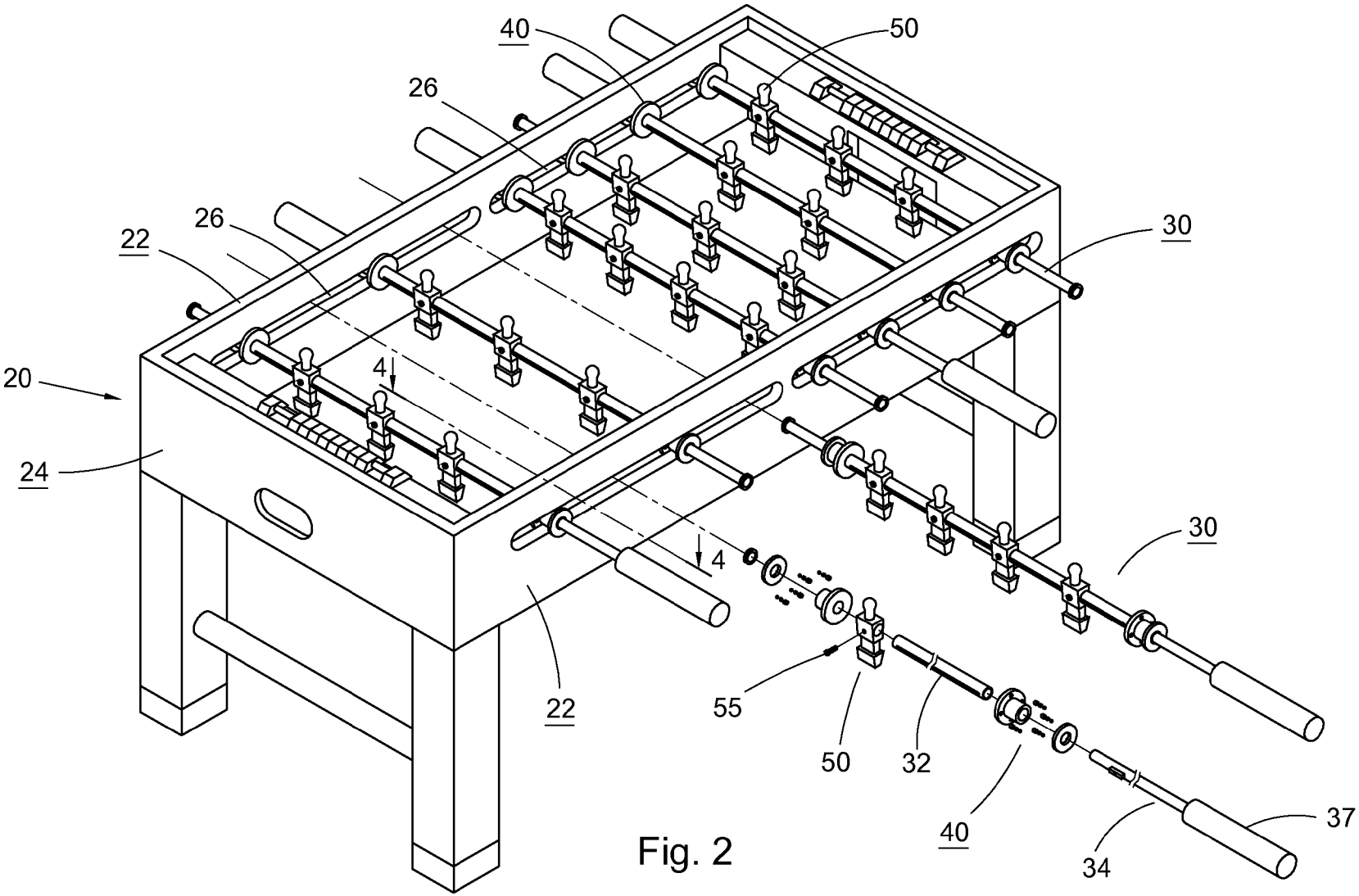
FIG. 2 is a perspective partially exploded view according to FIG. 1.

Please refer to FIGS. 1 and 2. According to a first embodiment, the soccer game table 10 of the present invention includes a table body 20 and several operation bars 30 mounted on the table body 20.

The table body 20 has two lateral sides 22 and two end sides 24 which define a game space 25 downward recessed from the top face. Each lateral side 22 is formed with at least one slide slot 26 passing through the lateral side from inner face to outer face. In this embodiment, there are two slide slots formed on each lateral side. The slide slots 26 lengthwise extend along the lateral side from one end side 24 to the other end side 24, and the slide slots on each lateral are arranged form one end side to the other end side.

Figure 3:
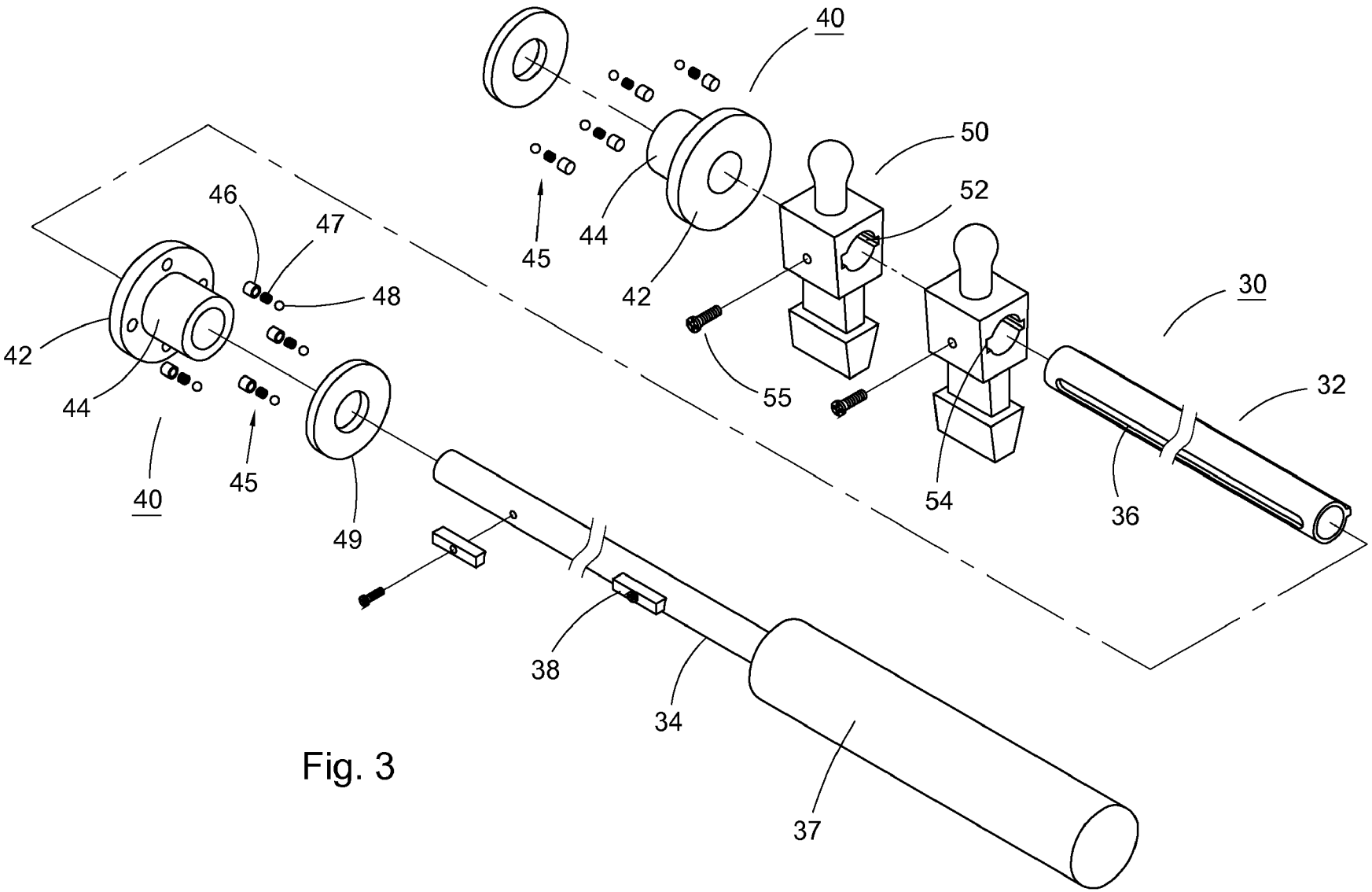
FIG. 3 is a perspective exploded view of the operation bar of the first embodiment of the present invention.
Figure 4:
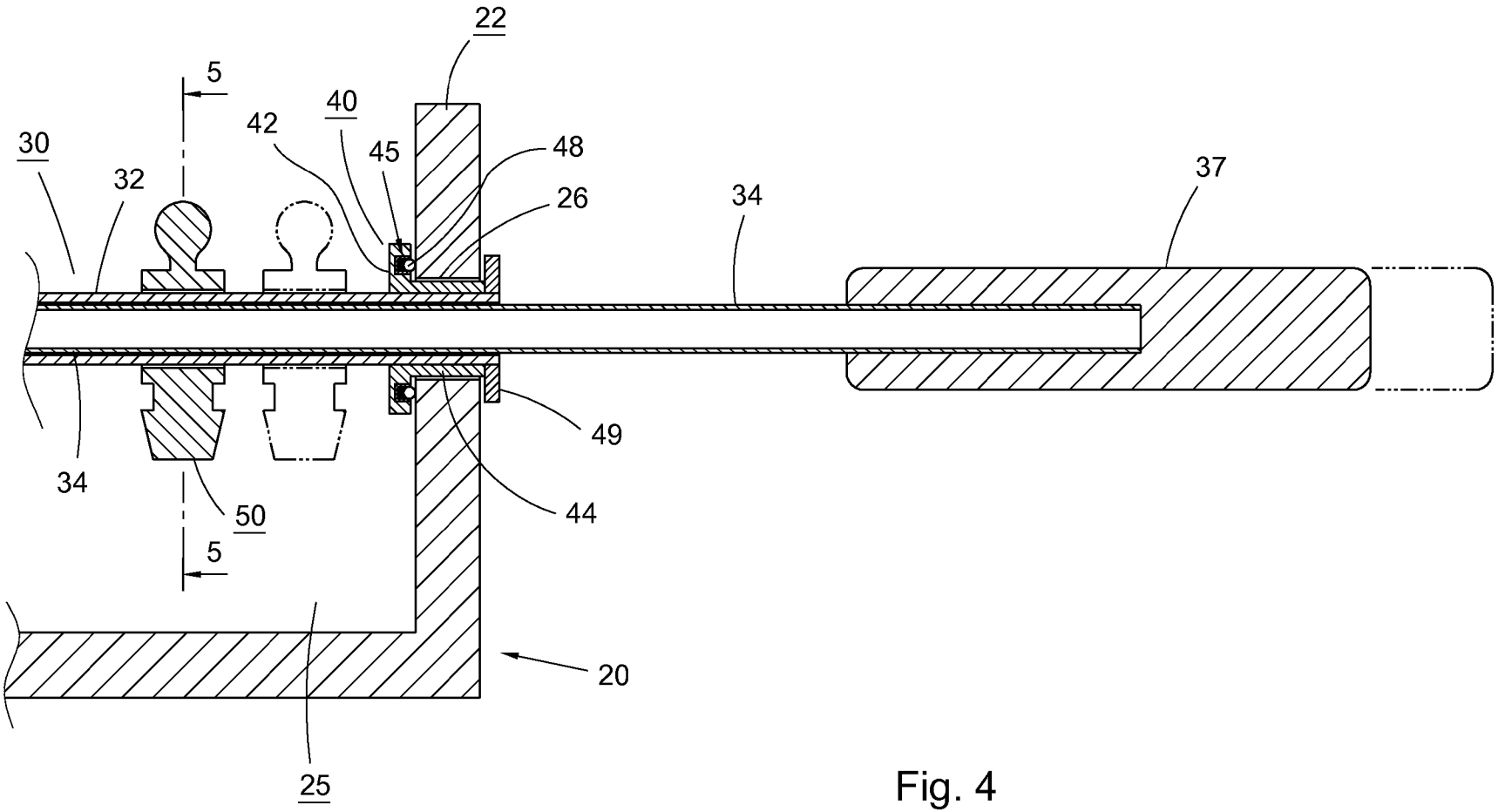
FIG. 4 is a sectional view taken along line 4-4 of FIG. 2.

Referring to FIGS. 3 and 4, each operation bar 30 has a hollow outer rod 32 and an inner rod 34 fitted in the outer rod. The cross-section of the outer and inner rods 32, 34 can be circular or polygonal. The inner rod is slidably fitted in the outer rod 32 and is longer than the outer rod 32. Accordingly, two ends of the inner rod 34 outward protrude from the outer rod 32. The outer rod 32 is formed with at least one lengthwise slit 36. A handle 37 is arranged at one end of the inner rod 34 of the operation bar 30 for a player to hold.

Figure 7:
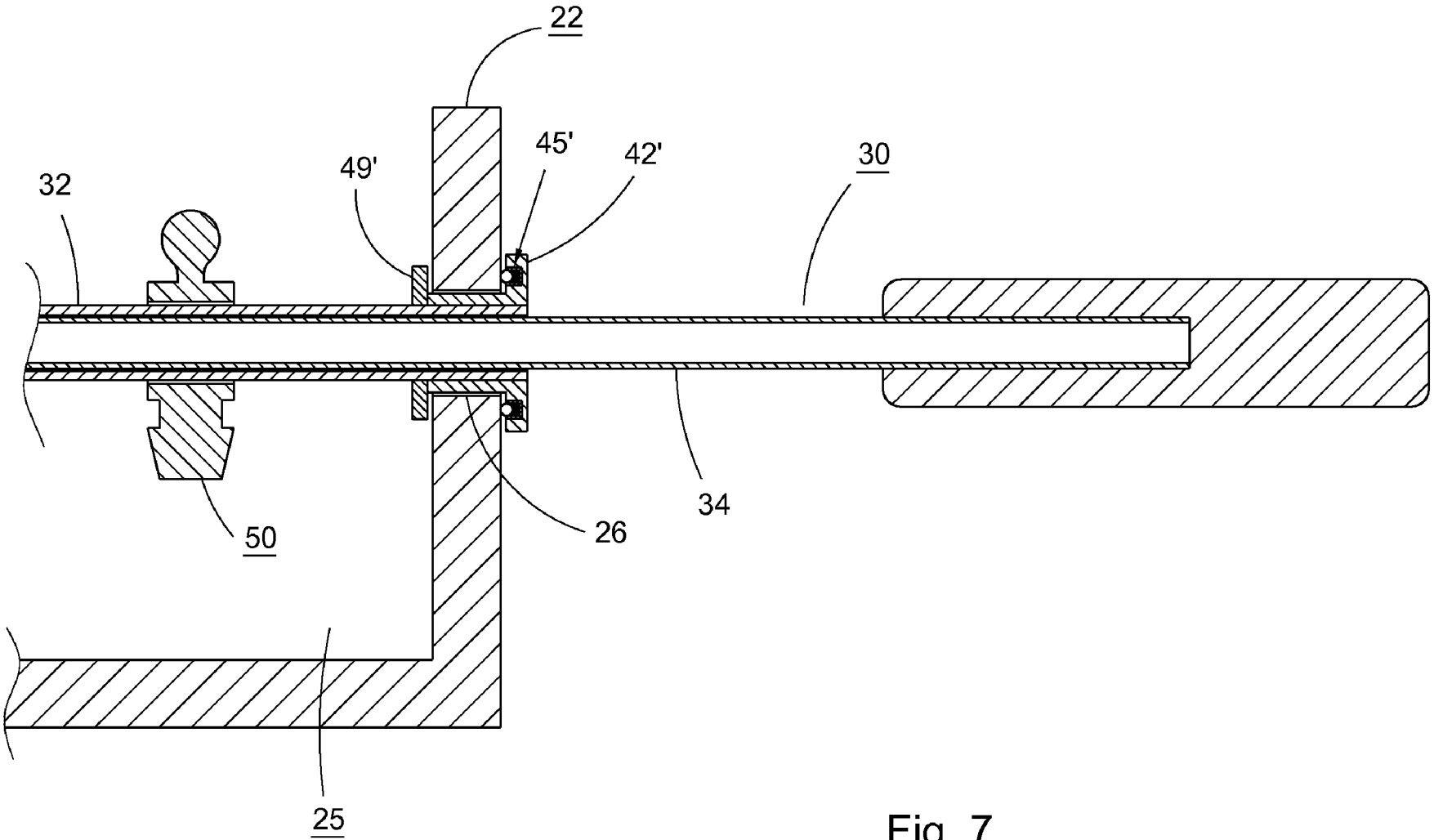
FIG. 7 is a sectional view of a second embodiment of the present invention, which is similar to FIG. 4.

The operation bars 30 are respectively fitted through the corresponding slide slots 26 of the lateral sides 22 of the table body 20 side by side as shown in FIG. 1. The outer rod 32 of the operation bar 30 is displaceable and rotatable along the slide slot 26 without being moved out of the slide slot 26. In order to achieve this object, each end of the outer rod 32 is fixed with a guide member 40 as shown in FIGS. 3 and 4. Each guide member 40 has a tray body 42 and sleeve body 44 connected with the tray body 42. The tray body 42 abuts against one face of the lateral side 22. The sleeve body 44 is positioned in the slide slot 26. As shown in FIG. 4, the tray body 42 can contact with the inner face of the lateral side. Alternatively, as shown in FIG. 7, the tray body 42 can contact with the outer face of the lateral side. Two ends of each outer rod 32 respectively abut against the two lateral sides 22 via two guide members 40. Accordingly, two ends of the outer rod are restricted from axially moving. Therefore, the outer rod can move along the slide slot 26 and rotate within the slide slot 26 without detaching from the lateral side and moving out of the slide slot. Several ball assemblies 45 are embedded in the tray body 42. Each ball assembly includes a cylindrical member 46, a spring 47 and a ball member 48. The ball member 48 will not drop out of the cylindrical member 46 and is pushed by the spring 47 to protrude from the tray body 42. The tray body contacts the face of the lateral side 22 via the ball members. Accordingly, the frictional resistance between the tray body and the lateral side can be reduced. In addition, a protective cap 49 is fixed at the free end of the sleeve body 44.

Figure 5:
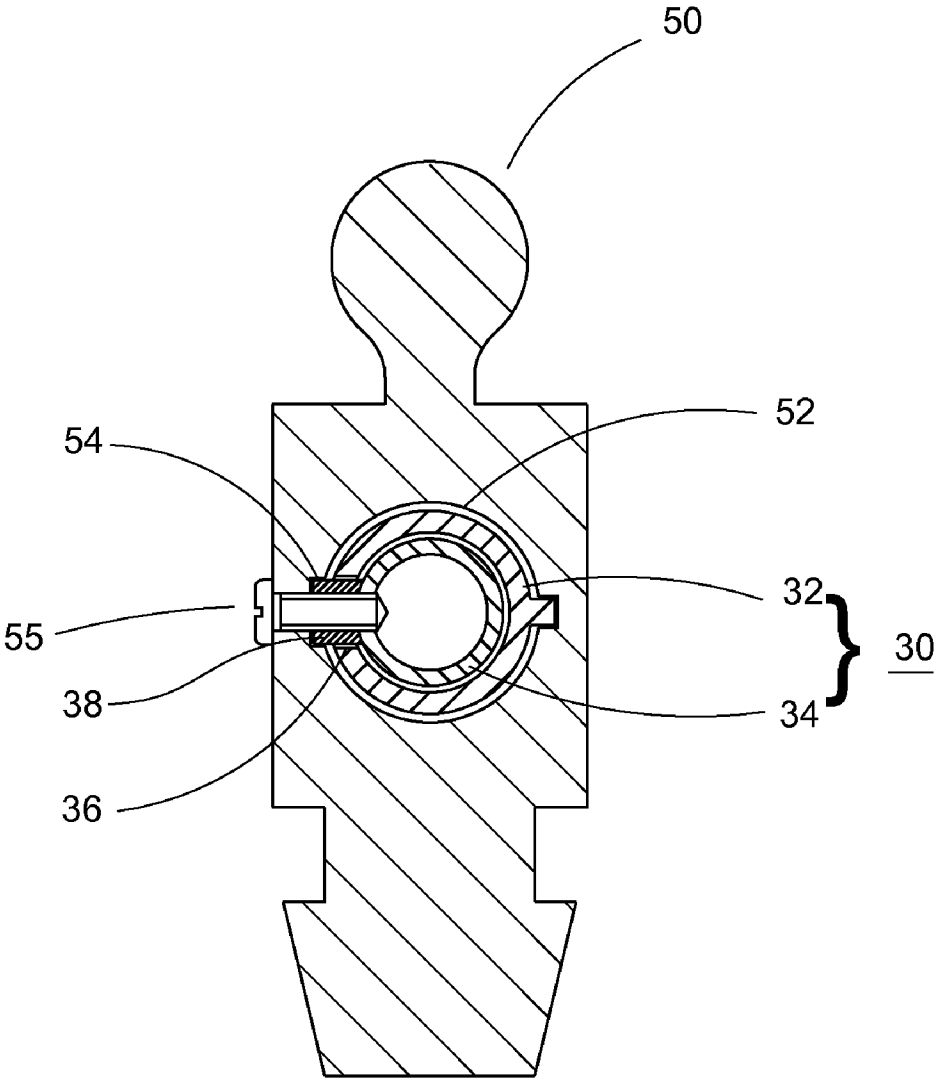
FIG. 5 is a sectional view taken along line 5-5 of FIG. 4.

Referring to FIG. 5, several driving blocks 50 each having a fitting hole 52 are fitted on the operation bars 30 via the fitting hole 52. The driving block 50 can be doll-shaped or otherwise shaped. Each operation bar 30 is mounted with at least one driving block. The driving block 50 is fixed on the operation bar with at least one fixing member 55 such as a screw. In this embodiment, the fixing member 55 is passed through the driving block 50 and the slit 36 of the outer rod 32 to fixedly connect with the inner rod 34. Accordingly, when rotating the operation bar via the handle 37, the inner and outer rods 32, 34 and the driving blocks 50 are rotated together. When pushing the inner rod 34 to slide within the outer rod 32, the inner rod drives the driving blocks to move together.

In addition, please refer to FIGS. 3 and 5. Several connecting pieces 38 are mounted on inner rods 34. Each connecting piece 38 is passing through the slit 36 of the outer rod 32 and is connected with a recess 54 of the driving block 50. Accordingly, the transmission between the inner rod and the driving block is enhanced. It should be noted that a long member could be mounted on each inner rod for replacing the connecting pieces on each inner rod.

Figure 6:
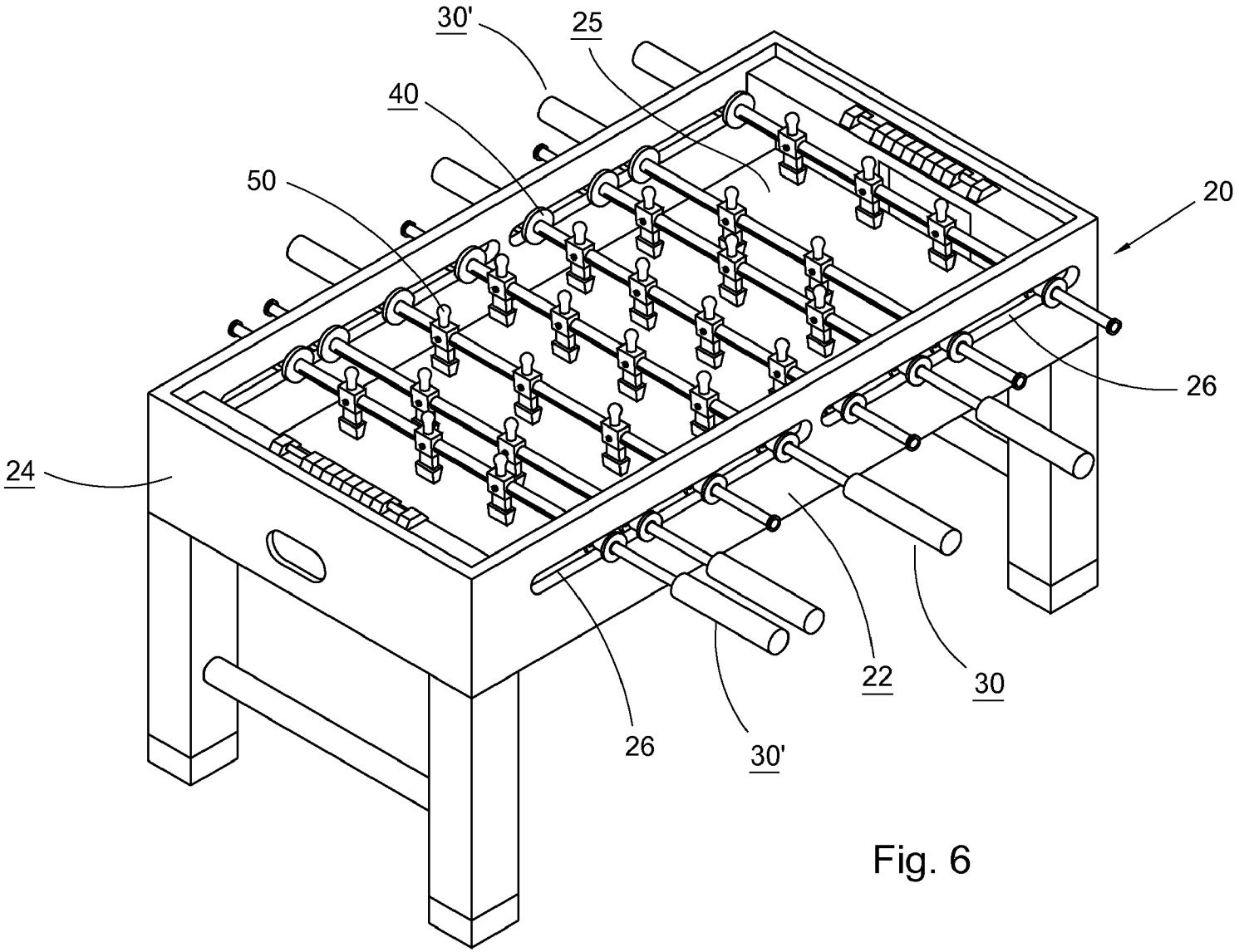
FIG. 6 shows the use of the present invention.

In use, a ball (not shown) is placed in the game space 25 and the operation bars 30 are operated to move the driving blocks 50 for driving the ball. When pushing/pulling the inner rod 34 of the operation bar 30, the inner rod drives the driving blocks 50 to move along the axis of the operation bar as shown in by the phantom line of FIG. 4. At this time, the outer rod 32 will not axially move. When rotating the inner rod 34, the inner rod 34, the outer rod 32 and the driving blocks 50 will be rotated together. In addition, referring to FIG. 6, a player can further transversely move the operation bar along the slide slot 26. The operation bars with numeral 30' are operations bar after transversely moved.

Accordingly, the operation bars 30 can be moved between the two lateral sides 22 and also moved between the two end sides 24 along the slide slots 26. Therefore, the operation bars can drive the driving blocks to two-dimentionally move so as to enhance the mobility of the driving blocks for more quickly and efficiently approaching the ball. Accordingly, the exciting and entertaining effect achieved by the soccer game table can be promoted.

Figure 8:
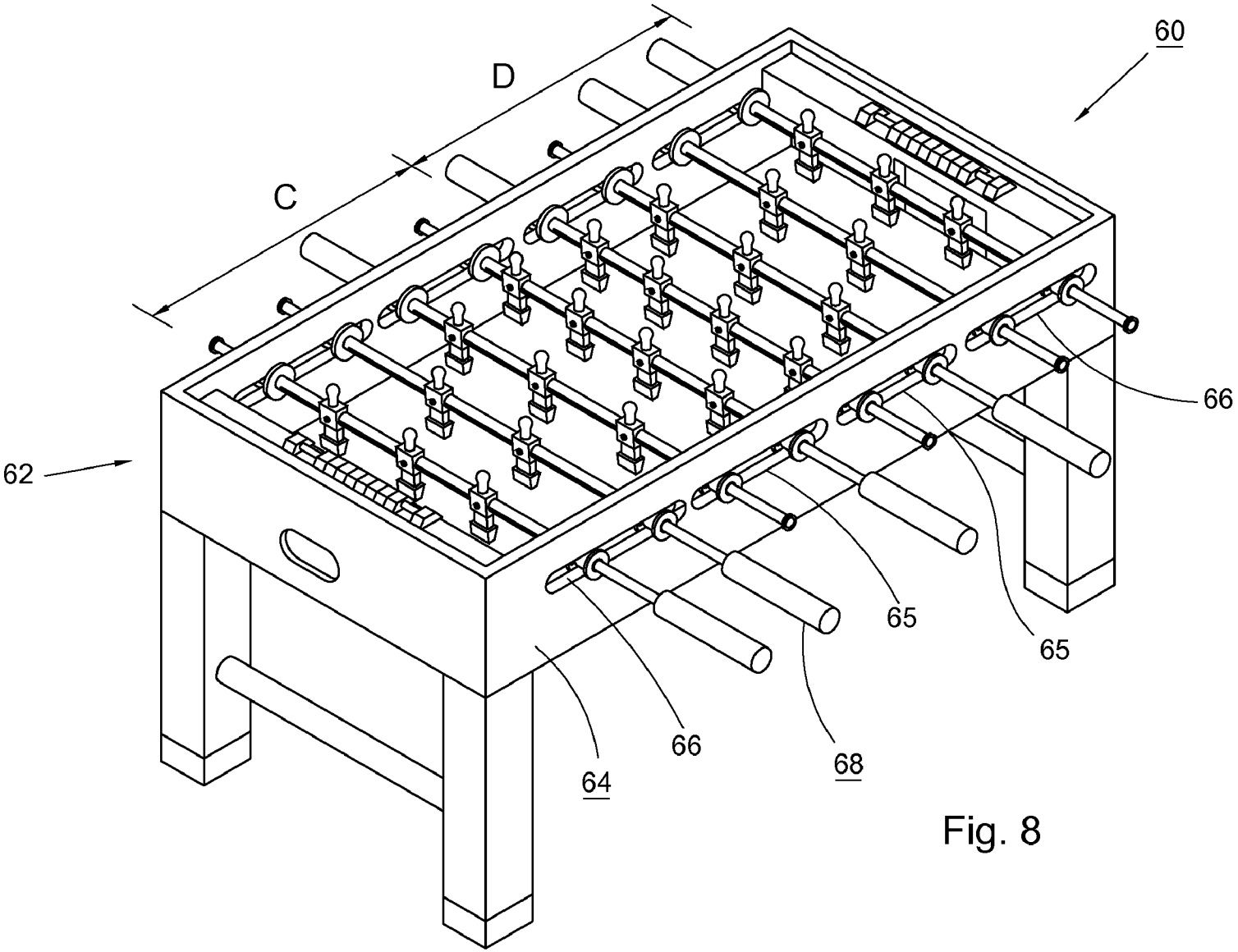
FIG. 8 is a perspective view of a third embodiment of the present invention.

FIG. 8 shows another embodiment of the soccer game table 60 of the present invention. Each half C, D of the lateral side 64 of the table body 62 is formed with two slide slots 65, 66. The range of the slide slots 65 is an attack region, while the range of the slide slots 66 is a defensive region. The operation bar 68 is identical to that of the first embodiment and thus will not be further described hereinafter.

Figure 9:
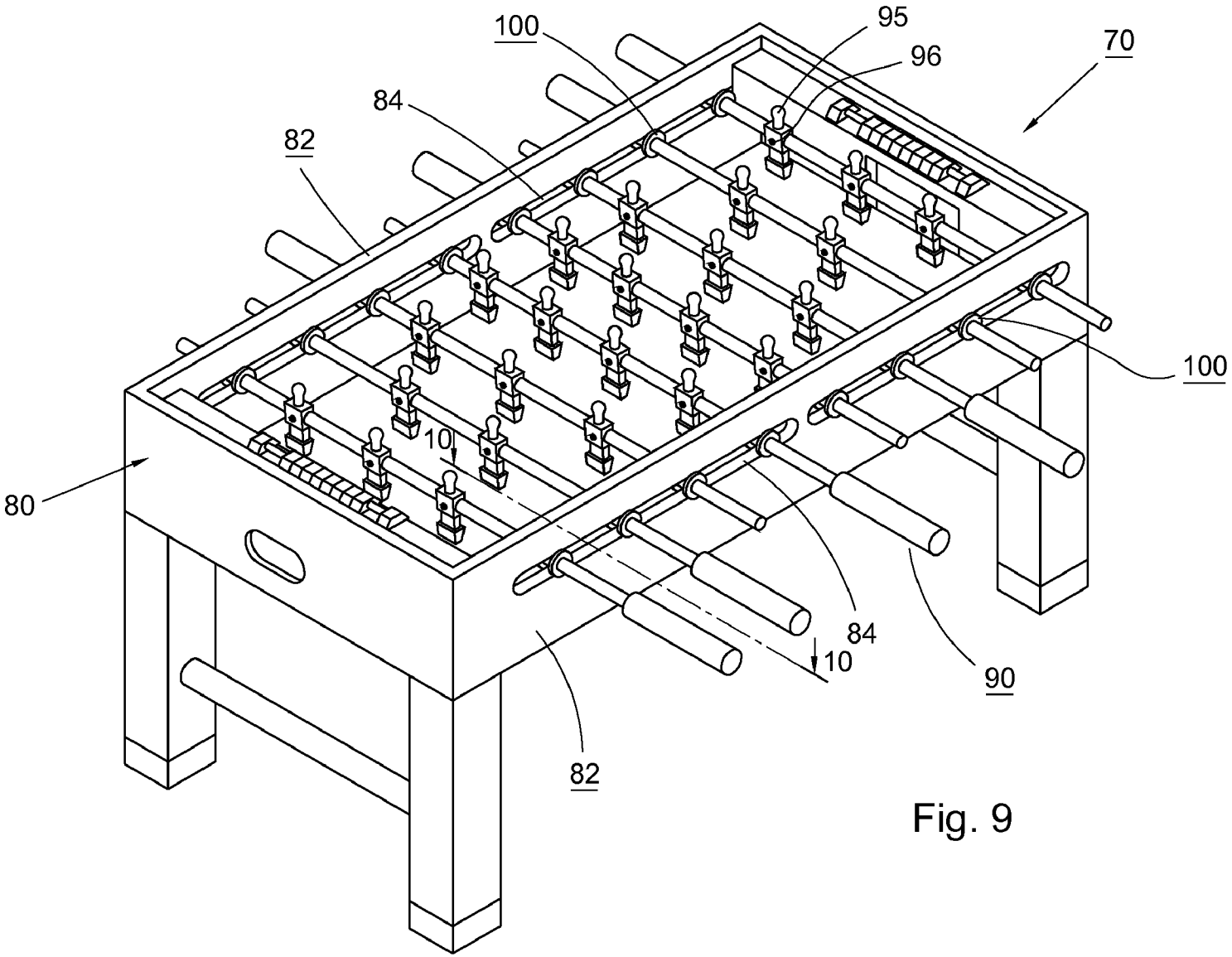
FIG. 9 is a perspective view of a fourth embodiment of the present invention.
Figure 10:
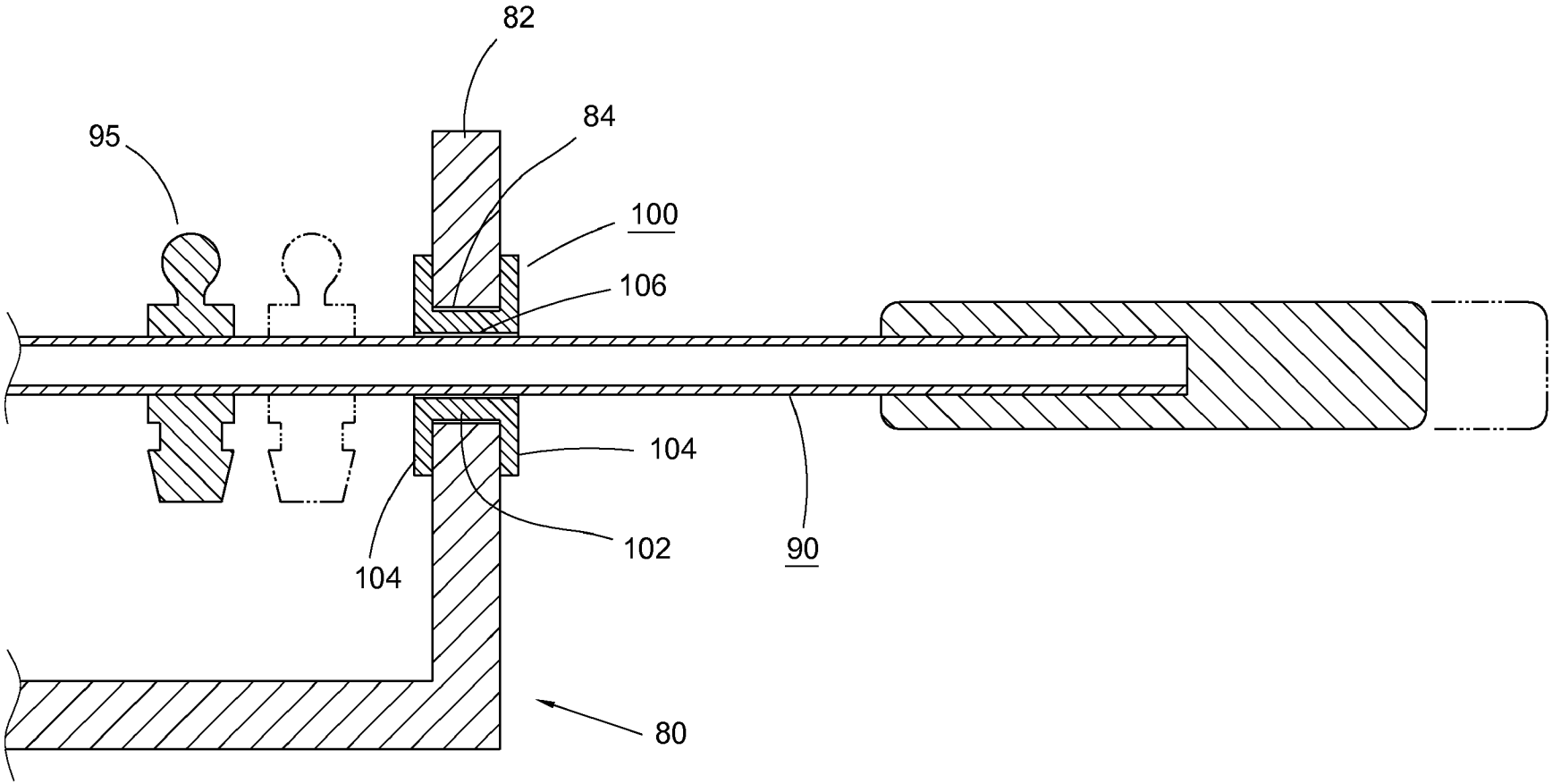
FIG. 10 is a sectional view taken along line 10-10 of FIG. 9.

FIGS. 9 and 10 show still another embodiment of the soccer game table 70 of the present invention. Each lateral side 82 of the table body 80 is formed with a predetermined number of slide slots 84. The operation bar 90 is a one-piece rod body. The operation bars 90 are fitted through the slide slots 84 of the two lateral sides 82. A predetermined number of driving blocks 95 are fixed on each operation bar. Each driving block 95 is fixed on the operation bar 90 with at least one fixing member 96.

A predetermined number of guide members 100 are respectively installed in the slide slots 84. The guide members 100 are movable within the slide slots 84 without getting out of the slide slots 84. Referring to FIG. 10, in this embodiment, the guide member 100 is a roller or the like. The guide member 100 has a sleeve section 102 mounted in the slide slot. Two ends of the sleeve section 102 respectively have two flanges 104 for respectively abutting against the inner and outer faces of the lateral side 82. Two ends of the operation bar 90 are respectively fitted through the through holes 106 of two opposite guide members 100. Accordingly, the operation bar can be moved and rotated within the guide members. When axially pushing/pulling the operation bar 90, the operation bar slides within the guide member 100. When rotating the operation bar, the driving blocks are rotated along with the operation bar. When transversely moving the operation bar, by means of the guide member, the operation bar is displaced along the slide slot. Accordingly, the operation bar can rotate the driving blocks and drive the driving blocks to two-dimentionally move.

Figure 11:
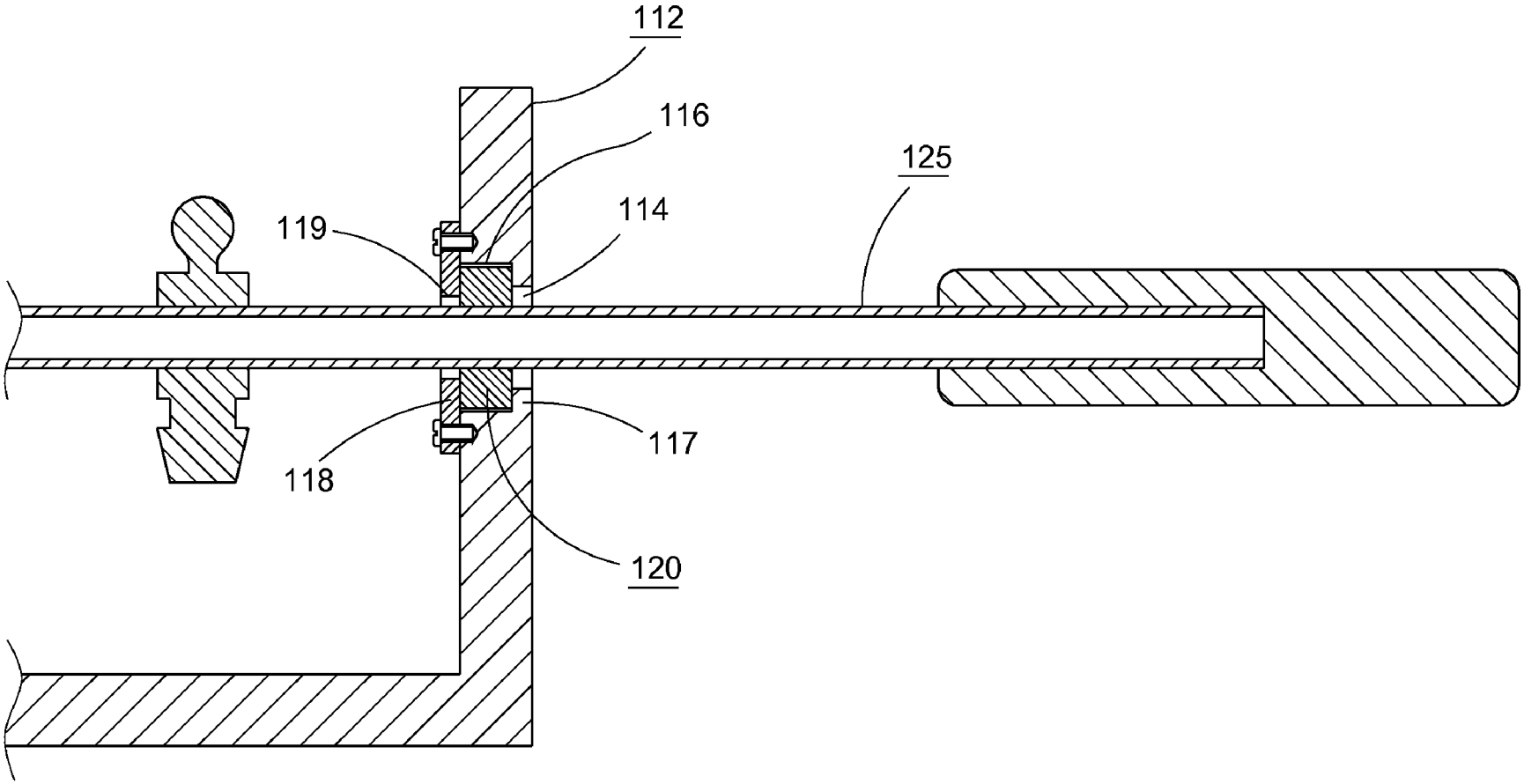
FIG. 11 is a sectional view of a fifth embodiment of the present invention.
Figure 12:
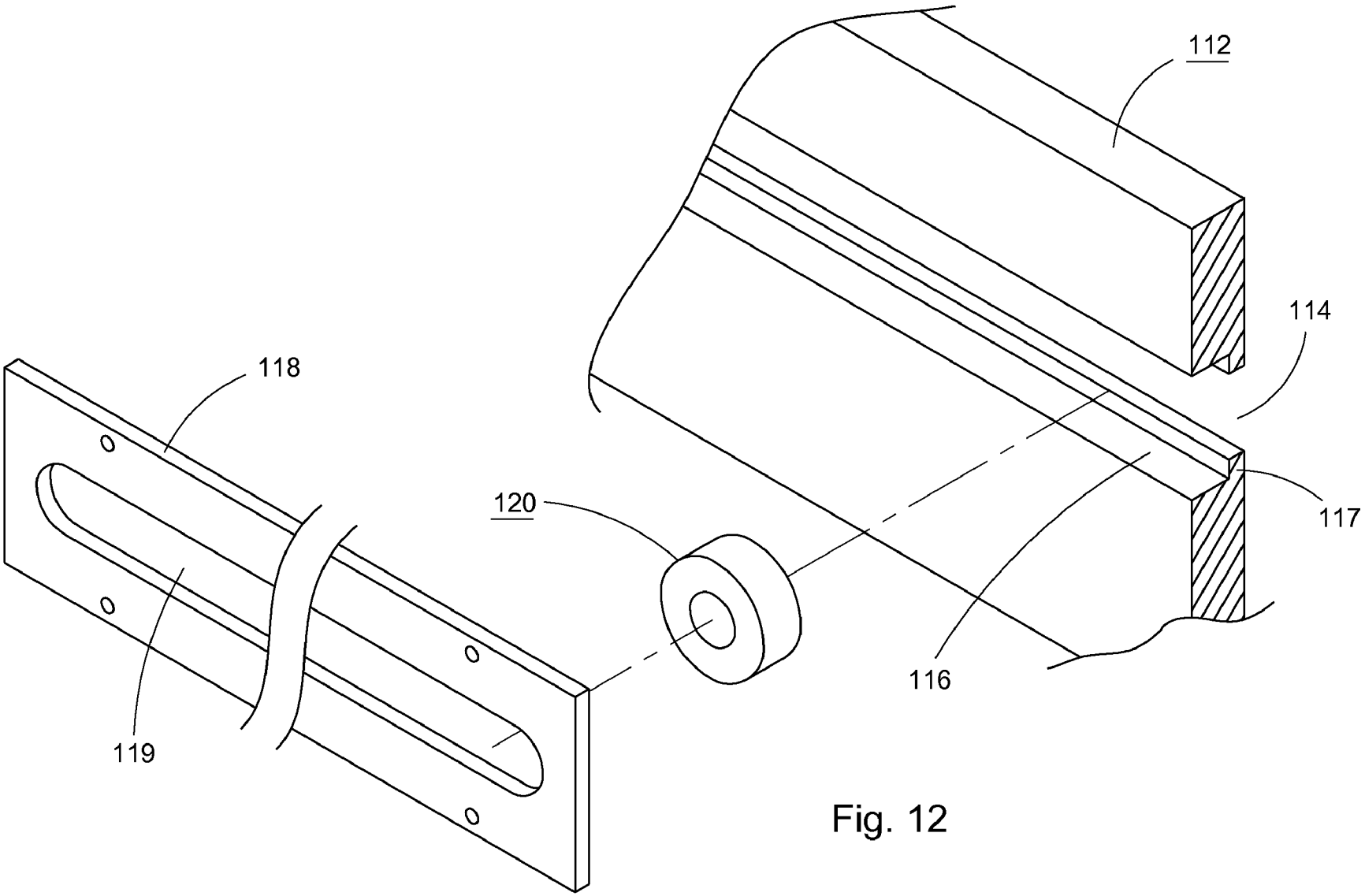
FIG. 12 is a perspective partially exploded view according to FIG. 11.

FIGS. 11 and 12 show still another embodiment of the present invention. A first shoulder edge 117 and a second shoulder edge 118 are respectively disposed on the inner and outer faces of each lateral side 112. The guide member 120 is a hollow collar, ring body, bearing or roller mounted in each slide slot 116. The guide member 120 is movable along the slide slot 116 and restricted by the shoulder edges 117, 118 from dropping out of the slide slot. Each end of the operation bar 125 is fitted through a guide member 120. In this embodiment, the second shoulder edge 118 is an elongated plate body fixed on one face of the lateral side. The plate body 118 is formed with a slot 119 corresponding to the slide slot.

Figure 13:
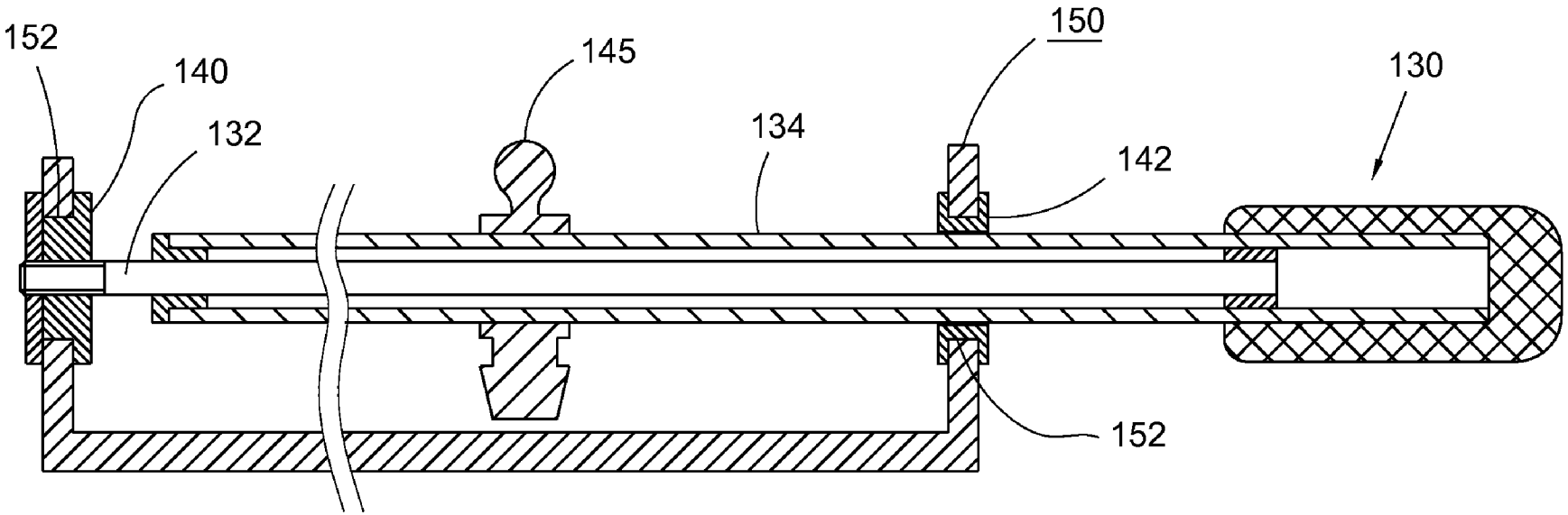
FIG. 13 is a sectional view of a sixth embodiment of the present invention.

FIG. 13 shows still another embodiment of the present invention, in which the operation bar 130 is composed of an inner rod 132 and an outer rod 134 fitted with each other. Two ends of the operation bar 130 are connected with two guide members 140, 142. One end of the inner rod 132 extends out of the outer rod 134 to fixedly connect with a guide member 140. Therefore, the inner rod 132 cannot be axially moved. The outer rod 134 is fitted through the other guide member 142 and is movable and rotatable within the guide member 142. At least one driving block 145 is fixedly connected with the outer rod 134. When pushing/pulling the outer rod 134, the outer rod is moved along the axis of the operation bar 130 to move the driving block 145. When rotating the outer rod 134, the driving blocks 145 are driven to rotate. By means of the guide members 140, 142, the operation bar can be moved along the slide slots 152 of the lateral sides 150 of the table body. The slide slots of the present invention can be any of the slide slots of the aforesaid embodiments.

According to the above arrangements, the soccer game table of the present invention provides a novel entertaining effect for the players.

The above embodiments are only used to illustrate the present invention, not intended to limit the scope thereof. Many modifications of the above embodiments can be made without departing from the spirit of the present invention.

What is claimed is:

1. A soccer game table comprising:

a table body having two lateral sides and two end sides which define a game space downward recessed from a top face of the table body, each lateral side being formed with at least one slide slot lengthwise extending from one end side to the other end side;

a predetermined number of operation bars, each operation bar having a hollow outer rod and an inner rod fitted in the outer rod, the inner rod being slidable in the outer rod with its two ends outward protruding from the outer rod, the outer rod being formed with at least one lengthwise slit, two ends of the outer rod of each operation bars being respectively arranged in two opposite slide slots of the two lateral sides of the table body, the operation bars being rotatable and displaceable along the slide slots;

a predetermined number of driving blocks mounted on the operation bars and positioned in the game space; and a predetermined number of fixing members, each the fixing member being passed through the slit of the outer rod, one end of the fixing member being connected with the driving block, while the other end of the fixing member being connected with the inner rod, whereby when the inner rod slides within the outer rod, the inner rod drives the driving blocks to move and when rotating the inner rod, the inner rod, the outer rod and the driving blocks are rotated together.

2. The soccer game table as claimed in claim 1, further comprising a predetermined number of guide members respectively mounted at two ends of the outer rod of the operation bar, each guide member having a tray body for abutting against one face of the lateral side.

3. The soccer game table as claimed in claim 2, wherein the tray bodies of the two guide members mounted at two ends of the outer rod respectively abut against inner faces of the two lateral sides of the table body.

4. The soccer game table as claimed in claim 2, wherein the tray bodies of the two guide members mounted at two ends of the outer rod respectively abut against outer faces of the two lateral sides of the table body.

5. The soccer game table as claimed in claim 2, wherein each guide member further has a sleeve body positioned in the slide slot, the tray body being connected with one end of the sleeve body, the sleeve body of the guide member being connected with one end of the outer rod.

6. The soccer game table as claimed in claim 5, further comprising a protective cap with a central through hole, the protective cap being connected with the other end of the sleeve body to abut against the other face of the lateral side.

7. The soccer game table as claimed in claim 2, further comprising a predetermined number of ball assemblies disposed in the tray body of the guide member, whereby the tray body contacts one face of the lateral side via the ball assemblies.

8. The soccer game table as claimed in claim 1, wherein each lateral side is formed with two slide slots, the slide slots are arranged from one end side to the other end side.

9. The soccer game table as claimed in claim 1, wherein each lateral side is formed with four slide slots, the slide slots are arranged from one end side to the other end side.

10. A soccer game table comprising:

a table body having two lateral sides and two end sides which define a game space downward recessed from a top face of the table body, each lateral side being formed with at least one slide slot lengthwise extending from one end side to the other end side;

a predetermined number of guide members respectively disposed in the slide slots and movable along the slide slots, each guide member having a through hole passing through the guide member from one end to the other end;

a predetermined number of operation bars, two ends of each operation bars being respectively fitted through the through holes of two opposite guide members of the two lateral sides; and a predetermined number of driving blocks respectively fixed on the operation bars and positioned in the game space.

11. The soccer game table as claimed in claim 10, wherein each guide member has a sleeve section mounted in the slide slot and two flanges respectively formed at two ends of the sleeve section, whereby the two flanges respectively abut against the inner and outer faces of the lateral side.

12. The soccer game table as claimed in claim 10, wherein two shoulder edges being respectively disposed on the inner and outer faces of the lateral side, the guide member being movable along the slide slot and being restricted by the two shoulder edges.

13. The soccer game table as claimed in claim 12, wherein an elongated plate body is fixed on one face of the lateral side to serve as one of the shoulder edges.

14. The soccer game table as claimed in claim 10, wherein each lateral side is formed with two slide slots, the slide slots are arranged from one end side to the other end side.

15. The soccer game table as claimed in claim 10, wherein each lateral side is formed with four slide slots, the slide slots are arranged from one end side to the other end side.

16. A soccer game table comprising:

a table body having two lateral sides and two end sides which define a game space downward recessed from a top face of the table body, each lateral side being formed with at least one slide slot lengthwise extending from one end side to the other end side;

a predetermined number of guide members respectively disposed in the slide slots and movable along the slide slots;

a predetermined number of operation bars, each operation bar being composed of a hollow outer rod and an inner rod relatively slidably fitted in the outer rod, two ends of the operation bar being respectively connected with two opposite guide members of the slide slots of the lateral sides, the operation bars being rotatable and movable along the slide slots; and a predetermined number of driving blocks respectively mounted on the operation bars and positioned in the game space, the driving blocks being movable and rotatable along with the operation bars.

17. The soccer game table as claimed in claim 16, wherein one end of the inner rod of the each operation bar extends out of the outer rod to fixedly connect with a guide member, the outer rod being fitted through the other guide member and being movable along the inner rod, the outer rod being also rotatable within the other guide member, the driving blocks being fixedly connected with the outer rod of the operation bar.

* * * * *